United States Patent [19]

Gowins

[11] 3,942,794

[45] Mar. 9, 1976

[54] BASEBALL BATTING PRACTICE DEVICE

[76] Inventor: Tim Gowins, 10034 Antrim, Laporte, Tex. 77571

[22] Filed: Apr. 5, 1974

[21] Appl. No.: 458,232

[52] U.S. Cl. ..... 273/26 E

[51] Int. Cl.[2] ..... A63B 69/40

[58] Field of Search ..... 273/26 R, 29 A, 181 J, 273/35 R, 184 R, 184 B, 185 D, 197 R, 197 A, 26 E, 95 A

[56] References Cited

UNITED STATES PATENTS

| | | | |
|---|---|---|---|
| 2,818,255 | 12/1957 | Ponza | 273/26 E |
| 3,271,030 | 9/1966 | Mueller | 273/26 E |
| 3,547,437 | 12/1970 | Andersen | 273/26 E |
| 3,627,328 | 12/1971 | Becker | 273/197 R |

*Primary Examiner*—Richard J. Apley
*Assistant Examiner*—T. Brown

[57] ABSTRACT

There is disclosed a baseball supported by a downwardly curved, semirigid, composite cord, which in turn normally extends forwardly from the normally forwardly disposed end of a pole, the rearward end being swingable connected to a swing structure. Guy wires from the rear of the cord just forward of the pole extend to top of the swing structure and to the swing structure below the pole swing connection. Normally vertically extending coil springs, in plurality and spaced apart, extend from upper and lower cage members which extend diagonally outwardly and rearwardly from the front of the cage as disposed just rearwardly of the swing structure. When a batter strikes the ball with a bat the pole swings from the blow, and with the swing structure and rearwardly against the coil springs on the respective side of pole swing to urge the spring thus strike against by the pole, first to flex or bow responsive to the side swing of the pole, then to straighten back into vertical position. When the springs struck by the pole re-flex, or straighten up vertically, the counterflex of the springs imparts swinging motion in opposite direction to the pole, and the pole swings back at least to original position. When the ball returns, and at elevation in the strike zone, the batter again may swing at the ball. Obviously, a left handed batter stands to the right of the normal pole axis when he swings, while a right handed batter stands to the left of such axis.

6 Claims, 9 Drawing Figures

BASEBALL BATTING PRACTICE DEVICE

BACKGROUND OF THE INVENTION

The invention comprises a definite improvement over the expiring Ponza U.S. Pat. No. 2,818,255, 1957, a comprising two adjacent standards for left and right handed batters, with balls on irregularly curved, only slightly flexible and rather rigid swingable arms, returnable to initial position by the equivalent of torsion spring action with the standards. In case of the captive, hollow, flexible ball on flexible material arm substantially anchored to a standard, the blow in Mueller U.S. Pat. 3,271,030, the arm flexes responsive to the blow on the ball.

In the Andersen U.S. Pat. No. 3,547,437, the balls are at the ends of coil springs which in turn extend from the ends of arms fixed rigidly to a common standard to extend oppositely therefrom, the standard being motor driven. The O'Leary U.S. Pat. No. 3,663,018, 1972, is simply to a tethered ball, the tether comprising a long cord which extends from the outer end of a swing structure, swingable about a standard.

The invention relates to a pole extending centrally from a swing structure, and supported by guy lines which extend respectively upwardly and downwardly from pole connection to swing structure. A substantially rigid, slightly yieldable, cord assembly supports the ball outwardly from the pole. When the ball is struck by a batter the pole swings with the swing structure to which it is connected and strikes sidewardly against vertically extending coil springs sidewardly against vertically extending coil springs or resilient means which normally extend vertically between frame members directed diagonally rewardly and outwardly. Thus the pole, in striking the resilient means, bows them inwardly, but they reflex and straighten out and urge the pole, in return swing, back to central or forwardly extending position for the ball to be struck again.

As a primary object the invention provides a pole from the outer end of which the ball is supported to be struck, whereby the pole swings with a swing structure, the pole in course of rearward swing strikes sidewardly against, and bows the resilient means inwardly, after which the resilient means returns to normal upright position of initial extent; the force of return urging the pole to swing back around to initial position with the ball disposed forwardly to be struck again by a batter.

It is also an object of the invention to provide a pole swing return type device of this class, in which the ball, of a live latex or rubber material, is supported by a substantially rigid but slightly flexible composite cord, which includes the guy wires anchored centrally in the ball, and extending upwardly and downwardly to swing structure, swingable upon a standard or upright.

It is still another object of the invention to provide a device of this class equipped with a frame to rear of swing structure which extends outwardly and rearwardly on each side thereof with the sides of the frame comprising normally vertically extending coil springs disposed in substantially equally spaced apart relationship from forward coil nearest swing structure and in diagonally extending line of coils, successively spaced apart rearwardly and outwardly.

Also it is an object of the invention to provide a swingable pole that carries the ball to be struck, the pole swinging centrally with a swing structure, with upper and lower guy lines connected, respectely, to swing structure above and below the pole swing connection.

Other and further objects will be apparent when the specification hereinbelow is considered with relation to the drawings, as hereinbelow briefly described, and as further described in detail under the caption of DETAILED DESCRIPTION.

SUMMARY OF THE INVENTION

The invention may be summarized as comprising a live ball, as of rubber or latex, supported slightly less than rigidly from the outer end of a pole swingable with a swing structure, with the upper and lower guy lines or wires for the pole connected to swing structure above and below point of pole connection. As the ball is struck the pole swings rearwardly with the swing structure and upon contacy with a diagonally rearwardly and outwardly extending file or line or normally vertically disposed resilient means, the pole contact bows the resilient means inwardly. Then upon the resilient means springing back erect, the pole is urged back around by such return impulse to a normally forwardly extending position, for the ball to be struck again by a practice batter.

DETAILED DESCRIPTION

Figures 1, 9:
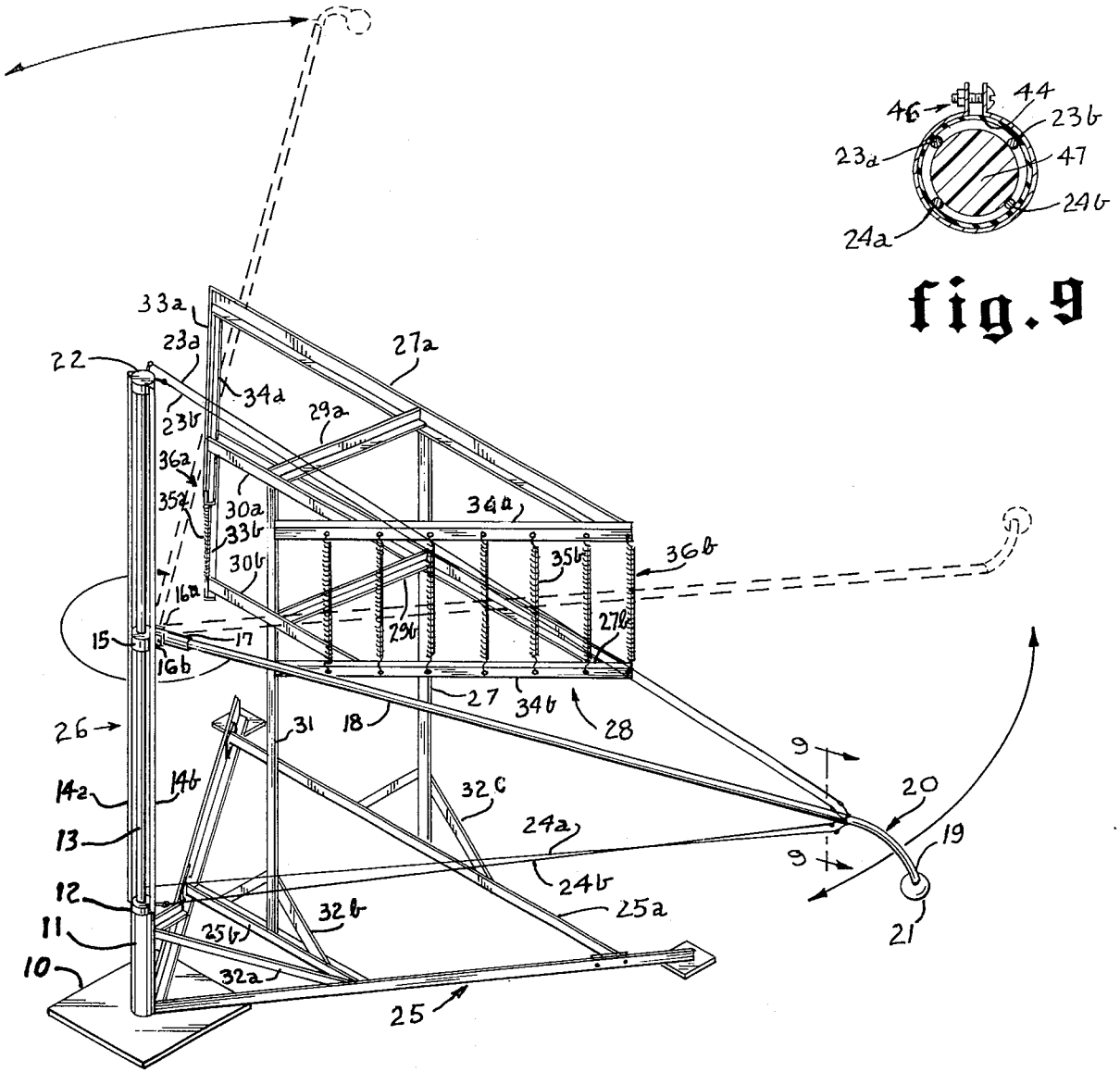
FIG. 1 is an isometric view of an embodiment of a baseball batting practice apparatus disclosing both the construction and action of the invention.
FIG. 9 is a large scale, transverse sectional elevational view taken along lines 9—9 of FIGS. 1–8.

Referring now in detail to the drawings in which like reference numerals are assigned to like elements in the various views, there is shown in the isometric view in FIG. 1 external structures representing the full action of the invention. A base 10 supports a hollow post or upright 11 with a lower swing ring 12 rotatable thereon and from which upstands centrally a standard or vertical axle 13. Vertically extending, oppositely spaced apart connection angles **14*a*, 14*b*, connect the lower swing ring 12 to a central swing ring 15 from which extend a pair of lugs 16*a*, 16*b*, intermediately between the connection angles 14*a*, 14*b*. A sleeve 17 extends from between the lugs 16*a*, 16*b*, and receives the inner end of a pole 18 therein, with the outer end of the pole 18 supporting a composite cord 20 from the lower arcuate, substantially rigid but slightly flexible forward part 19 of which a live ball 21,** as of rubber or latex, is supported.

From the opposed sides of the central swing ring 15, the angles 14*a*, 14*b* extend upwardly for connection at top to an upper swing ring 22. From the upper swing ring 22, guy wires 23*a*, 23*b*, extend to the outer end of the pole 18 to merge into the composite cord 20 as a part thereof. Also, from the lower swing ring 12, guy wires 24*a*, 24*b*, extend to the outer end of the pole 18 to merge into the composite cord 20, as a part thereof.

A triangular shaped angle frame 25, with apex at the rear of the post or upright 11, extends symmetrically rearwardly of the post 11 and swing standard assembly 26. An upright member 27 upstands centrally from the center of the base of the triangular frame structure 25, and bisects and has connected thereto for support, transversely extending frame members, as upper and lower rear angles 27*a*, 27*b*, substantially parallel to the base 25*a* of the triangular base angle frame 25, and forming the rear members of a spring cage frame 28.

Figure 3:
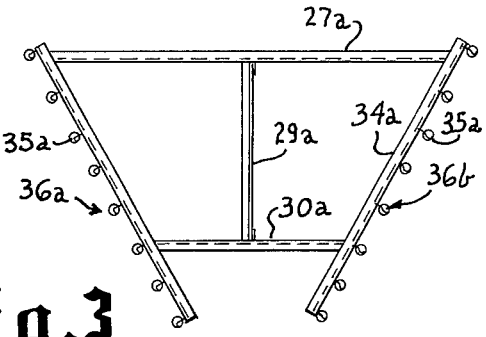
FIG. 3 is a plan view of FIG. 2.
Figure 2:
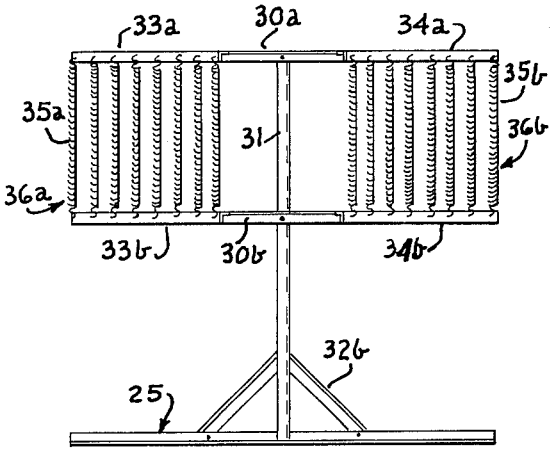
FIG. 2 is a front elevation view of the spring cage which effectuates pole swing.
Figure 4:
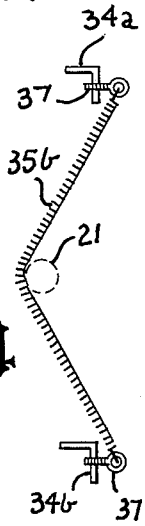
FIG. 4 is fragmentary diagrammatic elevation view demonstrating spring and pole action and reaction.

From the center of the upper and lower rear angles 27*a*, 27*b*, upper and lower central angles 29*a*, 29*b*, extend forwardly, and bisect respective upper and lower forward transverse or cross angles 30*a*, 30*b*. An upright member 31 extends downwardly through such intersections to a transverse cross member or angle 25*b* spaced rearwardly of the post or upright 11. Bracing members 32*a*, 32*b* and 32*c* are provided, respectively, for the post 11, upright 31, and upright 27. Upper and lower diagonally rearwardly and outwardly, horizontally extending angles 33*a* and 34*a* complete the left side of the spring cage 28 and upper and lower, diagonally rearwardly and outwardly, horizontally extending angles 33*b*, 34*b*, complete the right side of the spring cage frame 28. The ends of the transverse forward and rearward, upper members 30*a*, 27*a*, terminate within and against the left and right upper diagonally extending members 33*a*, 33*b* and 34*a*, 34*b*, respectively. Refer also to FIGS. 2, 3 and 4.

A series of vertical, substantially equally spaced apart tension coil springs or resilient means 35*a*, connected upwardly into the left side, diagonally extending, angle member 33*a*, and downwardly into the left side, diagonally extending angle member 33*b*, form the left spring member assembly 36*a*. Correspondingly vertical, substantially equally spaced apart tension coil springs or resilient means 35*b*, connected upwardly into the right side, diagonally extending angle member 34*a* and downwardly into the right side, diagonally extending angle member 34*b*, form the right spring member assembly 36*b*. FIG. 4 shows details of spring connections to upper and lower, diagonally extending angles; eye bolts 37 being shown connecting upper and lower ends of a coil spring 35*b* to respective diagonally extending angles 34*a*, 34*b*.

Figure 5:
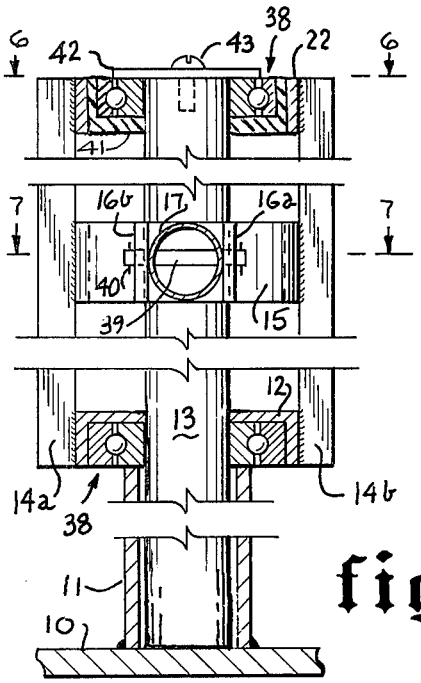
FIG. 5 is an enlarged, fragmentary, broken elevational view, showing details of swing structure and shaft, and of swing structure support, the pole assembly being connected to rotate with the swing structure.
Figure 6:
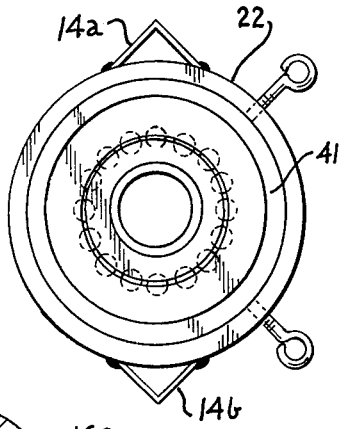
FIG. 6 is a sectional plan view taken along lines 6—6 of FIG. 5.
Figure 7:
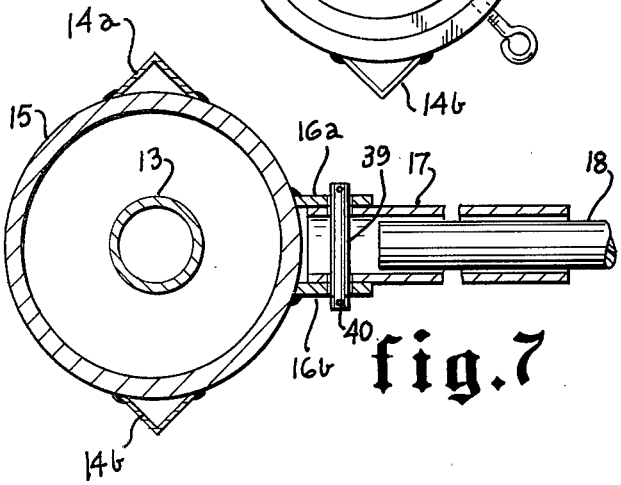
FIG. 7 is a sectional plan view taken along lines 7—7 of FIG. 5.

Now considering FIG. 5 with relation to FIGS. 6 and 7, the lower swing ring 12 is indicated as an inverted cup structure, and to the opposed side areas of the cup 12, the lower end portions of the vertical connection angles 14*a*, 14*b* are welded, or otherwise firmly connected. The standard or upright rod or tube 13, comprising an upright or vertical axle, passes through a bore centrally through the base of the cup 12, and is affixed thereto, as by welding. The outer race of a ball bearing assembly 38 is press-fitted upwardly into the cup 12, while the inner race receives the standard or rod 12 rotatably therethrough, and is supported upon the top surface of the post or upright 11 which extends upwardly from the base 10.

As shown in FIG. 7, a pin 39 passes through the sleeve 17 and lugs 16*a*, 16*b*, which are spaced apart to receive the inner end of the sleeve 17 therebetween, with the pin 39 being held against lateral displacement, as by cotter pins 40, indicated in FIG. 7.

As indicated in FIG. 5, a cup 41 is provided within the upper swing ring 22 which receives the outer race of a ball bearing assembly 38 press-fitted thereinto; the inner race receiving the top of the axle or standard 13 rotatable therethrough. A washer 42, of greater diameter than the groove between races, overextends such groove to protect against extraneous matter entering between the races of the ball bearing assembly, while a machine screw 43, through the center of the washer 42 and into the axle 13, holds such washer 42 in position, with the inner race of the ball bearing assembly 38 being capable of rotating with clearance thereunder.

Figure 8:
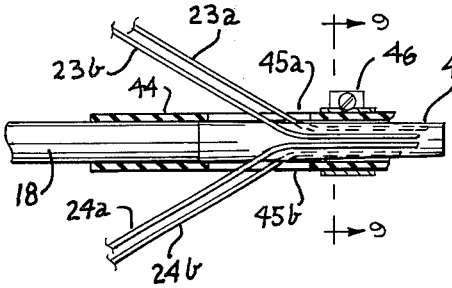
FIG. 8 is a sectional view of construction of ball, composite cord anchorage to pole, and of pole end portion, guy lines and ball relationship.
Figure 8:
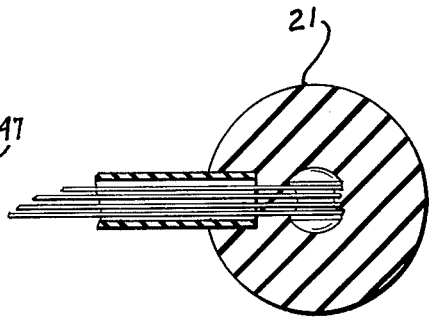

Now considering FIG. 8 with relation to FIG. 9, the pole 18 is shown terminating forwardly in the rear end of a substantially hard rubber sleeve 44, of slight flexibility. This sleeve 44 is shown with opposed slits 45*a*, 45*b* therein to let the upper and lower guy wires 23*a*, 23*b*, 24*a*, 24*b*, pass therein, and forwardly down the rubber sleeve 44.

A clamp 46 is fastened about the rubber sleeve 44 just forwardly of the entry of the guy wires thereinto and the sleeve, with guy wires therein, extends forwardly from the clamp 46. In FIG. 9 the clamp 46 is shown around the sleeve 44 with the wires 23*a*, 23*b*, 24*a*, 24*b*, just inwardly of the sleeve 44 and outwardly of a reenforcing rubber core 47. The rubber sleeve 44 terminates, as molded into the latex or live rubber ball 21, short of the center thereof, and a spool like member 48, of wood or metal, centrally disposed within the ball 21, has the forward or outer ends of the guy wires 23*a*, 23*b*, 23*c*, 23*d* secured therearound.

The invention is best adapted as a light duty, or versatile baseball batting practice device to serve a range of age groups, as from "little leaguers" to more advanced and sizeable players, up into high school ages, or even further, for college baseball players. The positive return features accomplished by flexible means, as tension coil spring reflex against being bowed by sideward swing of pole thereagainst, assures that the device is constant in operation, and that the ball will be returned to location of or batter next swing, whether the batter stands to left of the axis through the device, and bats the ball right handedly, or whether the batter stands to right of the axis through the device and bats the ball left handedly.

The structures shown may not be considered as limitations upon the structures or combinations of elements, that may be employed to fall within the broad spirit of the invention, while the appended claims are not by way of limitation, but by way of introduction, or designed to initiate start of examination.

I claim:

1. A baseball batting practice device comprising; a base structure having an elongated upright standard mounted thereon, said standard having intermediate its ends means mounting one end of an elongated pole thereon such that said pole is rotatable in a substantially horizontal plane about said standard, said pole having elongated and slightly flexible extension means on its outer end mounting a ball; a frame structure mounted on said base adjacent said standard and positioned a distance from said standard such that said pole will be engaged with said frame structure upon rotation in said horizontal plane; means mounted on said frame structure for engagement with said pole to cause said pole to rotate in the opposite direction after said means on said frame is engaged by said rotating pole; means on said standard for pivotally supporting one end of said pole for pivotal movement in a substantially vertical plane to allow said pole to be raised or lowered to a desired height of a batter and said pole will engage said means mounted on said frame when said ball is hit in one direction and will also engage said means mounted on said frame when said ball is hit in the direction opposite said one direction, each engagement of the pole with said means mounted on said frame causing said pole and ball to return substantially to a position from which said ball was hit.

2. The batting practice device of claim 1 wherein said upright stand is a first elongated tubular member telescopically received in a second tubular upright member having length shorter than said first tubular member and mounted on said base; said first upright member having three tubular sleeves rotatably mounted thereon, said sleeves being a first sleeve mounted on the upper extremity of said first tubular member, a second sleeve mounted adjacent the lower extremity of said first tubular member, and a third sleeve mounted intermediate said first and second sleeves; said sleeves being held at a fixed vertical distance apart by a pair of elongated vertically standing, parallel angle members, attached at diametrically opposite points on each of said sleeves; said third sleeve being said means for mounting said one end of said elongated pole on said upright standard, said guy lines extending from the outer end of said elongated pole to said first and second sleeves.

3. The batting practice device of claim 1, wherein said slightly flexible extension means is an elongated tubular member having one of its ends telescopically receiving the outer end of said elongated pole, the other end of said tubular member having said ball mounted thereon;

4. The batting practice device of claim 3 wherein said other end of said tubular member telescopically extends into said ball to a distance intermediate its outer surface and core, said tubular member having a pair of opposing apertures intermediate its ends, the other end of said guy lines each extending through an aperture, passed longitudinally through said tubular member and into said ball, encircling the core of said ball and returned through said tubular member and apertures and terminating at said first and second rotatable sleeves.

5. The batting practice device of claim 1 wherein said means mounted on said frame structure for engagement with said pole is at least one elongated, vertically extending resilient member.

6. The batting practice device of claim 1 wherein said frame structure mounted on said base comprises two substantially identical triangular shaped frame members, fixedly spaced one above the other and being in substantially parallel horizontal planes; said frame members each being positioned relative to said upright standard such that two of their sides diverge from said upright standard defining left and right diverging vertical planes; said means mounted on said frame structure for engagement with said pole being at least one elongated resilient member lying in each of said planes and extending vertically and having its ends attached to said upper and low frame member sides, said pole being engagable with said resilient member substantially midway its ends; said pole being swingable against said resilient member in said left plane when said ball is hit by a righthanded batter and is swingable against said resilient member in said right plane when said ball is hit by a lefthanded batter.

* * * * *